US005328437A

United States Patent [19]

Mayländer et al.

[11] Patent Number: 5,328,437

[45] Date of Patent: Jul. 12, 1994

[54] PAPER WEB FOLDER WITH LATERALLY SHIFTABLE FORMERS

[75] Inventors: Edgar Mayländer, Estenfeld; Günther O. Eckert; Burkard O. Herbert, both of Würzburg, all of Fed. Rep. of Germany

[73] Assignee: Koenig & Bauer Aktiengesellschaft, Wurzburg, Fed. Rep. of Germany

[21] Appl. No.: 16,271

[22] Filed: Feb. 11, 1993

[30] Foreign Application Priority Data

Feb. 13, 1992 [DE] Fed. Rep. of Germany ..... 4204254

[51] Int. Cl.[5] ..... B65H 45/28; B65H 45/22; B41F 13/58

[52] U.S. Cl. ..... 493/357; 493/440; 493/479

[58] Field of Search ..... 493/356, 357, 358, 359, 493/360, 439, 440, 476, 479

[56] References Cited

U.S. PATENT DOCUMENTS

| | | | |
|---|---|---|---|
| 1,186,970 | 6/1916 | Cottrell | 493/439 |
| 1,770,350 | 7/1930 | Jordhoy | 493/440 |
| 1,874,728 | 8/1932 | Willis | 493/357 |
| 1,893,816 | 1/1933 | Wood | 493/439 |
| 2,283,060 | 5/1942 | Hathaway | 493/439 |
| 3,540,723 | 11/1970 | Bolza-Schvenemann et al. | 493/360 |
| 3,942,782 | 3/1976 | Hermach | 493/439 |
| 4,083,390 | 8/1889 | Tucker | 493/360 |
| 5,088,975 | 2/1972 | Ghilardi | 493/359 |
| 5,137,505 | 8/1992 | Ishii et al. | 493/476 |

FOREIGN PATENT DOCUMENTS

| | | |
|---|---|---|
| 668877 | 12/1938 | Fed. Rep. of Germany . |
| 2039844 | 8/1971 | Fed. Rep. of Germany . |
| 2441970 | 9/1974 | Fed. Rep. of Germany . |
| 91244 | 8/1971 | German Democratic Rep. . |
| 57151565 | 11/1981 | Japan . |
| 1354924 | 5/1974 | United Kingdom . |

*Primary Examiner*—William E. Terrell
*Attorney, Agent, or Firm*—Jones, Tullar & Cooper

[57] ABSTRACT

A paper web folder for a rotary web-fed press uses two laterally shiftable formers and folding roller pairs on a first level and a stationary former and folder on a second level to provide the capability of forming and folding various full width paper webs into two or three equal part web width ribbons. These ribbons can then be associated with each other to form various products.

7 Claims, 3 Drawing Sheets

PAPER WEB FOLDER WITH LATERALLY SHIFTABLE FORMERS

FIELD OF THE INVENTION

The present invention is directed generally to a paper web folder with laterally shiftable formers. More particularly, the present invention is directed to a paper web folder for longitudinally folding several paper webs. Most specifically, the present invention is directed to a paper web folder with laterally shiftable formers for folding several partial paper webs all having the same width in a web-fed rotary printing press. A single paper web is printed by an impression cylinder and is then slit or cut into a plurality of equal width partial paper webs. One of these partial webs can selectively be directed to a stationary former on a first level while the remaining several partial webs can be directed to laterally shiftable formers on a second level. It is also possible to not use the stationary former and to laterally shift the movable formers to accommodate various width partial paper webs.

DESCRIPTION OF THE PRIOR ART

In the field of web-fed rotary printing presses, it is generally well known to print multiple pages or sheets in a side by side orientation across a web and to then longitudinally slit or cut the web into two or more partial width paper webs. These partial width paper webs are then directed to formers and folding rollers so that they can be longitudinally folded prior to be being cut transversely. In these prior art devices there is little flexibility or capability for adaptation to different paper web widths or to varying partial width web demands.

In the German patent specification No. 668 877 there is shown an adjustable double former for rotary printing presses in which the formers are arranged adjacent each other at different levels. In this prior art device, one of the formers with an accompanying single-former roller is capable of being laterally adjusted. With this double former, it is possible to cut various paper web widths into two partial paper webs, each having the same partial web width, and to provide these partial paper width webs with longitudinal folds. A limitation of this prior art arrangement of double folders is that only two partial ribbons can be folded.

Another prior art device is shown in German Democratic Republic patent No. 91 244. This disclosure is directed to a device for longitudinally slitting paper-webs for the folder of a rotary printing press. A laterally shiftable former for different paper-web widths is provided. With this prior art device, it is possible to halve a paper-web as well as to cut a paper web into three parts or to bring a one-third web to a two-thirds web and to fold this two-thirds web. This prior art device is not capable of separately folding several paper web ribbons.

There is a need for a paper web folder that is able to form and fold various partial paper-width webs separately and at the same time. The paper web folder with laterally shiftable formers in accordance with the present invention provides such a device and is a significant improvement over the prior art devices.

SUMMARY OF THE INVENTION

It is an object of the present invention to provide a paper web folder.

Another object of the present invention is to provide a paper web folder with laterally shiftable formers.

A further object of the present invention is to provide a paper web folder with laterally shiftable formers in a rotary printing press.

Yet another object of the present invention is to provide a paper web folder with a stationary part web former at a first level and with laterally shiftable part web formers at a second level.

Still a further object of the present invention is to provide a paper web folder with laterally shiftable formers for longitudinally folding paper webs with which it is possible to fold either two or three partial web widths from a single paper web having a maximum width.

As will be discussed in greater detail in the description of the preferred embodiment which is presented subsequently, the paper web folding device in accordance with the present invention receives a full width printed paper web from a rotary web fed printing press. This full width paper web can be slit into two or three partial width webs each having the same partial web width. If the web is longitudinally slit into three partial width webs, the center one of the three is directed to a stationary former at a first level which longitudinally forms and folds the first partial paper web which is a $\frac{1}{3}$ width web into a 1/6 web width ribbon. The two outside $\frac{1}{3}$ width paper webs are directed to a second level and through two laterally shiftable formers and folders to produce two additional 1/6 web width ribbons. These three ribbons can then be combined. If the full width paper web is to be longitudinally slit into only two $\frac{1}{2}$ width paper webs, these are then both fed to the laterally shiftable formers on the second level and the stationary former on the first level is unused. The two laterally shiftable formers and their associated folding roller pairs are shifted so that the two $\frac{1}{2}$ paper width webs are longitudinally formed and folded along their longitudinal centerlines.

An advantage of the paper web folder with laterally shiftable formers and folding rollers in accordance with the present invention is its ability to allow a paper web of one impression cylinder width to be used to manufacture two or more products that are to be folded. For example, there can be manufactured or printed a newspaper with four pages adjacent each other across the width of the web or six pages of a telephone book across the width of the web with either of these two different products being able to be longitudinally formed and folded using the paper web folder of the present invention. In addition, the total paper web width can also be adjusted with a resultant corresponding variance in the width of the products being folded. The paper web folder in accordance with the present invention also does not require the various angle bars and guide rollers which have been part of the prior art devices.

The paper web folder with laterally shiftable formers and folding rollers in accordance with the present invention overcomes the limitations of the prior art devices. It accordingly is a substantial advance in the art.

BRIEF DESCRIPTION OF THE DRAWINGS

While the novel features of the paper web folder with laterally shiftable formers in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
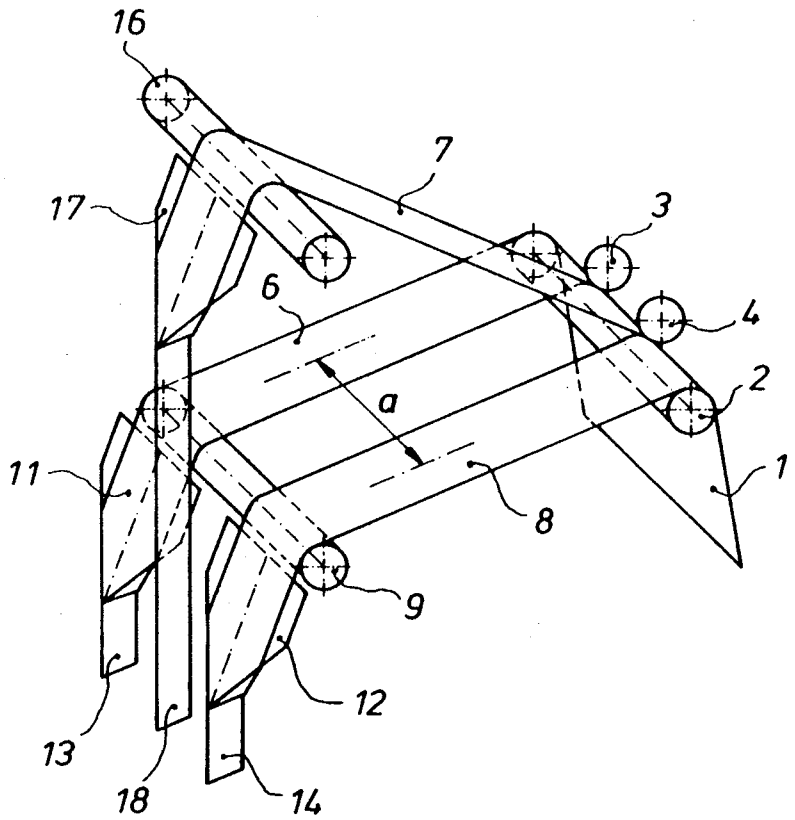
FIG. 1 is a perspective schematic depiction of a paper web folder with laterally shiftable formers in accordance with the present invention in use folding three partial paper-webs of the same width.

Referring initially to FIG. 1, there may be seen a preferred embodiment of a paper web folder with laterally shiftable formers in accordance with the present invention. This paper web folder is usable with a web-fed rotary printing press that is not specifically shown, to longitudinally slit and fold a printed paper web and to form a plurality of partial web width ribbons that can then be associated to produce a suitable product such as a newspaper, telephone directory or the like. The associated ribbons are typically cross-cut and transversely folded after their longitudinal forming and folding. However the present invention is directed only to the longitudinal slitting, forming, and folding of the full width paper web into a plurality of partial web width ribbons.

As may be seen in FIG. 1, a full width paper web 1 which has been printed is guided to the paper web folder of the present invention by way of a suitable drag roller 2. Above the drag roller 2 there are positioned two slitting knives 3 and 4 which may be in the form of slitting rollers. These two slitting knives or rollers 3 and 4 longitudinally slit or cut the full width paper web 1 into three $\frac{1}{3}$ width partial paper webs 6, 7, and 8, all of which typically will have the same partial web width. The two outside partial width paper webs 6 and 8 are guided in the level of the drag roller 2 to a roller top of former 9 and thence to two laterally shiftable formers 11 and 12. These two partial width paper webs 6 and 8 each leave the formers 11 and 12, respectively as one-sixth paper-web width ribbons 13 and 14 respectively each of which having been longitudinally formed and folded.

The third central $\frac{1}{3}$ width partial paper web 7 is guided into a stationary former by being guided to a higher level to a roller top of a former 16 with a stationary former 17 which forms the $\frac{1}{3}$ width paper web 7 into another 1/6 web width ribbon 18. This third ribbon 18 is then guided between the two ribbons 13 and 14 which were formed by the laterally shiftable formers 11 and 12. Since the center partial web 7 is taken from the center of the paper web 1 and further since the two formers 13 and 14 which operate on the two outside partial paper webs are laterally shiftable, the overall width of the full width of paper web 1 can be varied. The distance "a" between the imaginary center lines of the two outer partial width webs 6 and 8 will be varied in accordance with the spacing between the middle of the nose of the formers 11 and 12. The two slitting knives 3 and 4 can be laterally shifted a corresponding amount to insure that the three partial width webs each have the same width. The resulting three one-third wide partial paper webs 6, 7, and 8 could, for example correspond to the width of three double pages of a telephone book with the overall width of the paper web being variable.

Figure 1A:
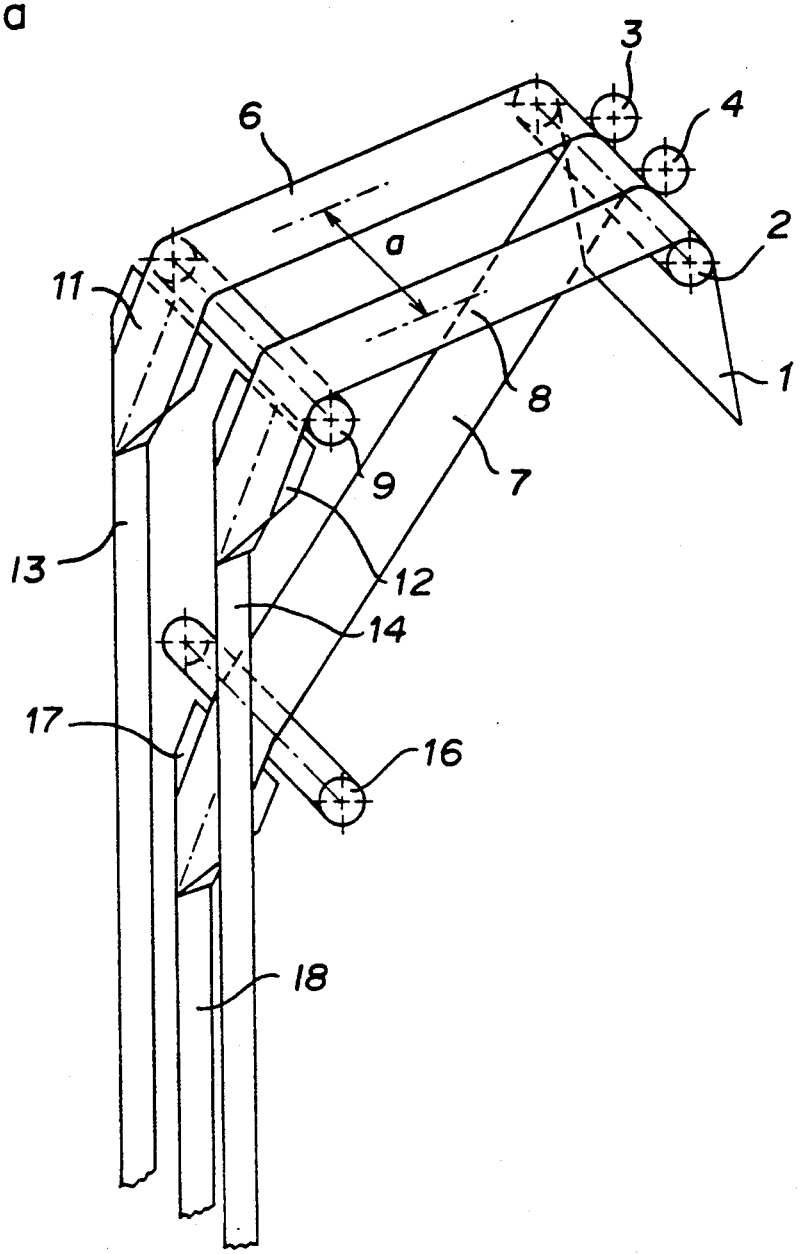
FIG. 1*a* is a perspective schematic depiction of a paper web folder generally similar to FIG. 1 and showing the third paper web former and folder positioned on a second level beneath the first level.

The second level of the paper web folder depicted in FIG. 1 on which is arranged the roller top of former 16 and the former 17 is shown as being above the first level on which is arranged the roller top of the former 9 and the laterally shiftable formers 11 and 12. It will be understood that the second level could be as effectively placed beneath the first level, as seen in FIG. 1*a*.

Figure 2:
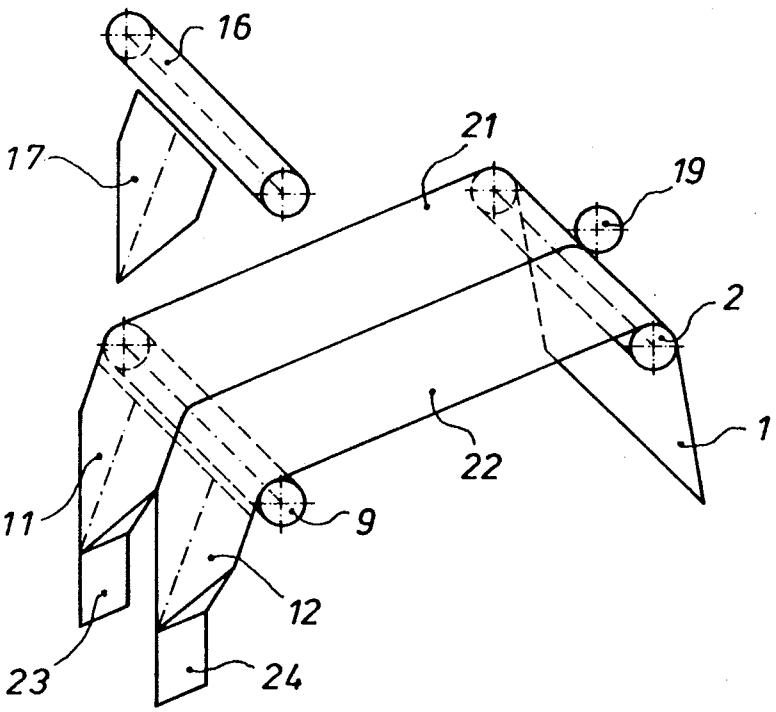
FIG. 2 is a view generally similar to FIG. 1 but showing the forming and folding of the paper web into two partial webs having the same width.

Turning now to FIG. 2, there is shown the use of the paper web folder of the present invention to longitudinally slit and fold a full width paper web 1 into two half width partial webs 21 and 22. In this use of the paper web folder, only one slitting knife or slitting roller 19 is used to form a central longitudinally extending slit in the full width paper web 1 and to accordingly divide the web into the two half web width partial paper webs 21 and 22. These two partial width paper webs 21 and 22 are guided in the same level to the roller top of former 9 and thence to the two laterally shiftable formers 11 and 12 which have been placed in essentially abutting side by side position. The slitting knife 19 can be one of the slitting knives 3 or 4 assuming that they are axially shiftable along the lead in drag roller 2. The other slitting knife of the two slitting knives 3 and 4 which is not required is placed out of operation. The two $\frac{1}{2}$ width paper webs 21 and 22 exit the laterally shiftable formers 11 and 12 as two $\frac{1}{4}$ web width ribbons 23 and 24 which can be associated together and further handled. In this mode of operation, the roller top of former 16 with the stationary former 17, arranged on the second level, is not used.

Figure 3:
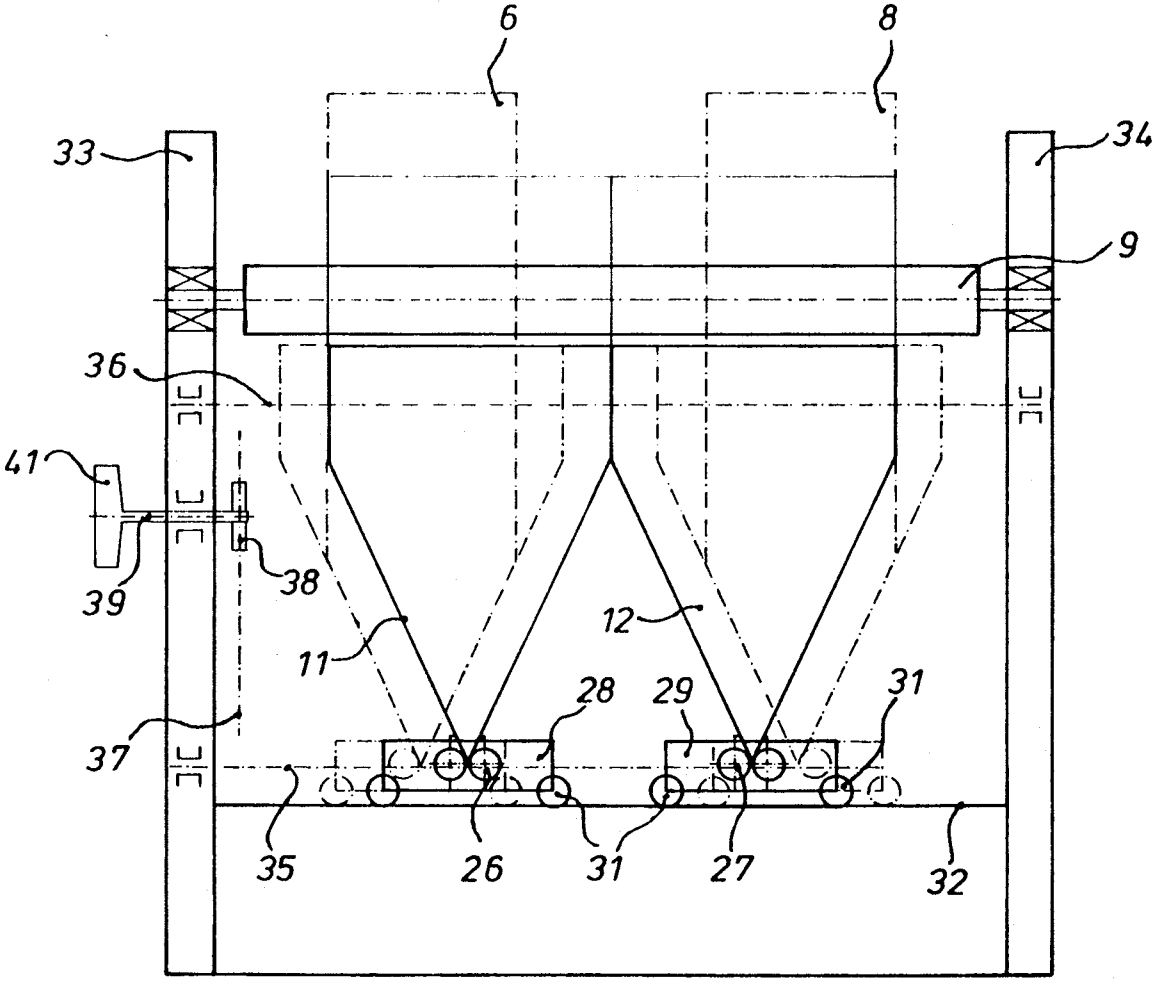
FIG. 3 is a front elevation view of the paper web folder of the present invention and showing the shiftable formers and folding rollers.

A detailed representation of the laterally shiftable former assembly, depicted somewhat schematically in FIGS. 1 and 2, is shown in FIG. 3. The two laterally shiftable formers 11 and 12 are arranged adjacent each other on the first level of the paper web folder and are laterally shiftable in a direction which is generally across or transverse to the direction of travel of the paper webs 6 and 8. In other words, laterally shiftable formers 11 and 12 are shiftable in the axial direction of the roller top of former 9 and parallel to the same, below the roller top of former 9.

At the noses of the formers 11 and 12 there are positioned generally conventional folding roller pairs 26 and 27. These folding roller pairs 26 and 27 are supported in suitable frames 28 and 29 which are, in turn supported on rollers 31 and are laterally shiftable on a support plate 32. The support plate 32 is fixed between the side frames 33 and 34 of the machine.

It will be appreciated that both the formers 11 and 12 and their associated folding roller pairs 26 and 27 must be shifted laterally by the same amounts for the paper web folder to operate correctly. A folding roller frame adjusting spindle 35 is rotatable supported between the side frames 33 and 34 and is in engagement with the folding roller frames 28 and 29. A similar former adjusting spindle 36 is rotatably supported between the side frames 33 and 34 and is in engagement with the formers 11 and 12. Each of these spindles 35 and 36 is provided with opposed threads on either side of the longitudinal center line of the folder. Thus rotation of the spindles 35 and 36 will move the frames 28 and 29 or the formers 11 and 12 either toward or away from the longitudinal center line of the assembly. Synchronous rotation of the two spindles 35 and 36 is accomplished by providing a toothed drive belt 37 that passes around suitable toothed peripheral portions or disks or gears on the adjusting spindles 35 and 36. This toothed drive belt 37 is driven by a toothed disk 38 which is connected by a shift 39 to a rotatable hand wheel 41. Rotation of the hand wheel 41 effects synchronous rotation of adjusting shafts 35 and 36 and hence coordinated movements of frames 28 and 29 for folding roller pairs 26 and 27 in concert with lateral movement of the formers 11 and 12. Alternatively, each of the adjusting spindles 35 and 36 could be provided with electrical synchronous motors. As is seen in FIG. 3, the adjusting spindles 35 and 36, the shaft 39 and the roller top of former 9 are all supported generally parallel to each other in the side frames 33 and 34.

In FIG. 3, the laterally shiftable formers 11 and 12 are depicted in solid lines in their positions wherein they receive ½ paper web width partial webs and form ¼ web width paper ribbons. This is the position shown in FIG. 2. These folders 11 and 12 are also shown in dot-dash lines in their laterally separated positions for use in receiving the two ⅓ paper width webs 6 and 8 and in forming 1/6 paper width ribbons 13 and 14, as they are shown in FIG. 1. In this latter depiction, the third ⅓ paper width web 7 that is formed and folded by the stationary former 17 and which is subsequently associated with the other two partial web width ribbons 13 and 14 is not shown for the sake of clarity.

While a preferred embodiment of a paper web folder with laterally shiftable formers in accordance with the present invention has been set forth fully and completely hereinabove, it will be apparent to one of skill in the art that a number of changes in, for example, the overall width of the paper web, the specific supports for the roller top of the formers, the structure of the side frames and the like can be made without departing from the true spirit and scope of the present invention which is accordingly to be limited only by the following claims.

What is claimed is:

1. A paper web folding assembly usable to longitudinally fold a paper web into a plurality of partial paper web width ribbons, said paper web folding assembly comprising:

means for receiving a full width paper web moving in a direction of travel from an impression cylinder;

means for slitting said full width paper web longitudinally in said direction of travel selectively into two or three equal partial paper width webs;

first and second paper web formers and folding rollers positioned on a first level and adapted to receive two of said partial paper width webs;

means supporting said first and second paper web formers and folding rollers for concurrent shifting of said first and second paper web formers and folding rollers laterally toward and away from a centerline of said direction of travel of said full width paper web in accordance with the number of partial paper width webs into which the full width paper web is selectively slit; and a third paper web former and folding rollers positioned on a second level to receive a third one of said partial paper width webs when said full width paper web is selectively slit into three equal partial paper width webs.

2. The paper web folding assembly of claim 1 wherein said second level is above said first level.

3. The paper web folding assembly of claim 1 wherein said second level is below said first level.

4. The paper web folding assembly of claim 1 wherein said third paper web former and folding rollers is positioned on said centerline of said direction of travel of said full width paper web.

5. The paper web folding assembly of claim 1 wherein said means for supporting said first and second paper web formers and folding rollers for concurrent shifting includes a former adjusting spindle and a folding roller frame adjusting spindle.

6. The paper web folding assembly of claim 5 wherein said former adjusting spindle and said folding roller frame adjusting spindle are each opposed threaded spindles.

7. The paper web folding assembly of claim 6 wherein said former adjusting spindle and said folding roller frame adjusting spindle are concurrently driven by a toothed belt.

* * * * *